US010888113B2

(12) United States Patent
Li et al.

(10) Patent No.: US 10,888,113 B2
(45) Date of Patent: Jan. 12, 2021

(54) ELECTRONIC CIGARETTE OF LOW-TEMPERATURE HEATING

(71) Applicant: Shenzhen First Union Technology Co., Ltd., Shenzhen (CN)

(72) Inventors: Yonghai Li, Shenzhen (CN); Zhongli Xu, Shenzhen (CN); Shengjia Song, Shenzhen (CN)

(73) Assignee: Shenzhen First Union Technology Co., Ltd., Guangdong (CN)

( * ) Notice: Subject to any disclaimer, the term of this patent is extended or adjusted under 35 U.S.C. 154(b) by 74 days.

(21) Appl. No.: 15/990,484

(22) Filed: May 25, 2018

(65) Prior Publication Data

US 2018/0338535 A1 Nov. 29, 2018

(30) Foreign Application Priority Data

May 26, 2017 (CN) ..... 2017 2 0608591 U

(51) Int. Cl.

| | |
|---|---|
| ***A24F 5/04*** | (2006.01) |
| ***A24F 40/40*** | (2020.01) |
| ***A24F 40/485*** | (2020.01) |
| ***A24F 40/48*** | (2020.01) |
| ***A24F 40/20*** | (2020.01) |
| ***A24F 40/46*** | (2020.01) |
| ***A24F 47/00*** | (2020.01) |

(52) U.S. Cl.

CPC ..... *A24F 5/04* (2013.01); *A24F 40/20* (2020.01); *A24F 40/40* (2020.01); *A24F 40/46* (2020.01); *A24F 40/48* (2020.01); *A24F 40/485* (2020.01); *A24F 47/008* (2013.01)

(58) Field of Classification Search

CPC ..... A24F 47/008; A24F 2700/01; A24F 2700/03; A24F 40/20; A24F 40/48; A24F 40/485; A24F 40/57; A24F 42/60; A24F 5/04; A61M 15/002; A61M 15/0066

USPC ..... 131/179, 180, 191, 195, 198.1, 198.2, 131/199, 206, 210, 212.2, 215.3, 216, 223

See application file for complete search history.

(56) References Cited

U.S. PATENT DOCUMENTS 1,276,751 A * 8/1918 Gilbert ..... A24F 13/04 131/198.2
3,765,426 A * 10/1973 Halaby ..... A24F 5/00 131/176
2016/0367925 A1* 12/2016 Blackley ..... A24F 47/008

(Continued)

FOREIGN PATENT DOCUMENTS

KR 2016 0058565 A 5/2016
WO 2013/128176 A1 9/2013

(Continued)

*Primary Examiner* — Michael J Felton
*Assistant Examiner* — Taryn Trace Willett
(74) *Attorney, Agent, or Firm* — PROI Intellectual Property US; Klaus Michael Schmid

(57) ABSTRACT

An electronic cigarette of low-temperature heating is disclosed including: a housing, having an air inlet passage and an accommodation chamber formed therein; a plurality of buttons; each button having an air conductive passage; when one of the buttons is pressed down, the air conductive passage corresponding to the button communicates the air inlet passage and the accommodation chamber, to allow exterior air to flow along the air inlet passage and the air conductive passage consecutively to the accommodation chamber.

9 Claims, 4 Drawing Sheets

(56) References Cited

U.S. PATENT DOCUMENTS

| | | | | |
|---|---|---|---|---|
| 2017/0000191 | A1* | 1/2017 | Medina Rivero | A61M 15/06 |
| 2017/0224015 | A1* | 8/2017 | Basil | A24F 47/008 |
| 2017/0251718 | A1* | 9/2017 | Armoush | A24F 1/30 |

FOREIGN PATENT DOCUMENTS

| | | | | |
|---|---|---|---|---|
| WO | WO-2013128176 | A1 * | 9/2013 | |
| WO | 2015/070402 | A1 | 5/2015 | |
| WO | WO-2015070402 | A1 * | 5/2015 | A24F 47/008 |

* cited by examiner

ELECTRONIC CIGARETTE OF LOW-TEMPERATURE HEATING

TECHNICAL FIELD

The present disclosure relates to the field of electronic cigarettes, and in particular, to an electronic cigarette of low-temperature heating.

BACKGROUND ART

An electronic cigarette of low-temperature heating utilizes a solid vaporizable material (e.g. tobacco cigarette) heated at low temperature. Currently the market already has the incremental heating electronic cigarette at low temperature, but basically the incremental heating electronic cigarette utilizes an integral air inlet passage to make the air pass through the heated vaporizable material back and forth, resulting in delivering burnt flavor or peculiar smell to a user.

SUMMARY

In view of the drawbacks in the electronic cigarette of low-temperature heating known to the inventors, to solve a problem that the electronic cigarette utilizes an integral air inlet passage to make air pass through heated vaporizable material back and forth, resulting in delivering burnt flavor or peculiar smell to a user, the present disclosure generally relates to an electronic cigarette of low-temperature heating.

To overcome the above shortages, the present disclosure relates to an electronic cigarette of low-temperature heating including:

a housing, having an air inlet passage and an accommodation chamber formed therein;

a plurality of buttons, each button having an air conductive passage; when one of the buttons is pressed inwards toward the interior of the housing, the air conductive passage corresponding to the button communicates the air inlet passage and the accommodation chamber, to allow exterior air to flow along the air inlet passage and the air conductive passage consecutively to the accommodation chamber. The air conductive passage comprises an axial conductive pipe and a radial conductive pipe disposed on a pipe wall of the axial conductive pipe. When the button is pressed inwards toward the interior of the housing, the radial conductive pipe and the air inlet passage are aligned with each other to allow exterior air to flow from the air inlet passage, the radial conductive pipe and the axial conductive pipe consecutively to the accommodation chamber.

In some variations, the air inlet passage and the accommodation chamber are parallel with each other; the buttons are perpendicular with the air inlet passage and the accommodation chamber.

In some variations, a diameter of the axial conductive pipe is less than a width of the air inlet passage.

In some variations, the electronic cigarette of low-temperature heating further includes a heating component disposed inside the accommodation chamber;

In some variations, the electronic cigarette of low-temperature heating includes a plurality of holders configured for fixing the heating component in the accommodation chamber.

In some variations, the heating component includes a plurality of heating tubes, spaced to be disposed among the plurality of holders.

In some variations, each heating tube is surrounded by a heating wire.

In some variations, the electronic cigarette of low-temperature heating further includes a circuit board; the circuit board is respectively connected with multiple heating wires in parallel, when any one of the buttons are pressed down, the corresponding heating wire is conducted by electricity.

In some variations, the electronic cigarette of low-temperature heating further includes a power supply chamber for receiving the power supply.

Compared to the prior art known to the inventors, the electronic cigarette of low-temperature described herein has a novel structure, and is convenient for a user to use, it may avoid the problem that the air passes through heated vaporizable material back and forth, thus delivering burnt flavor or peculiar smell to a user.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
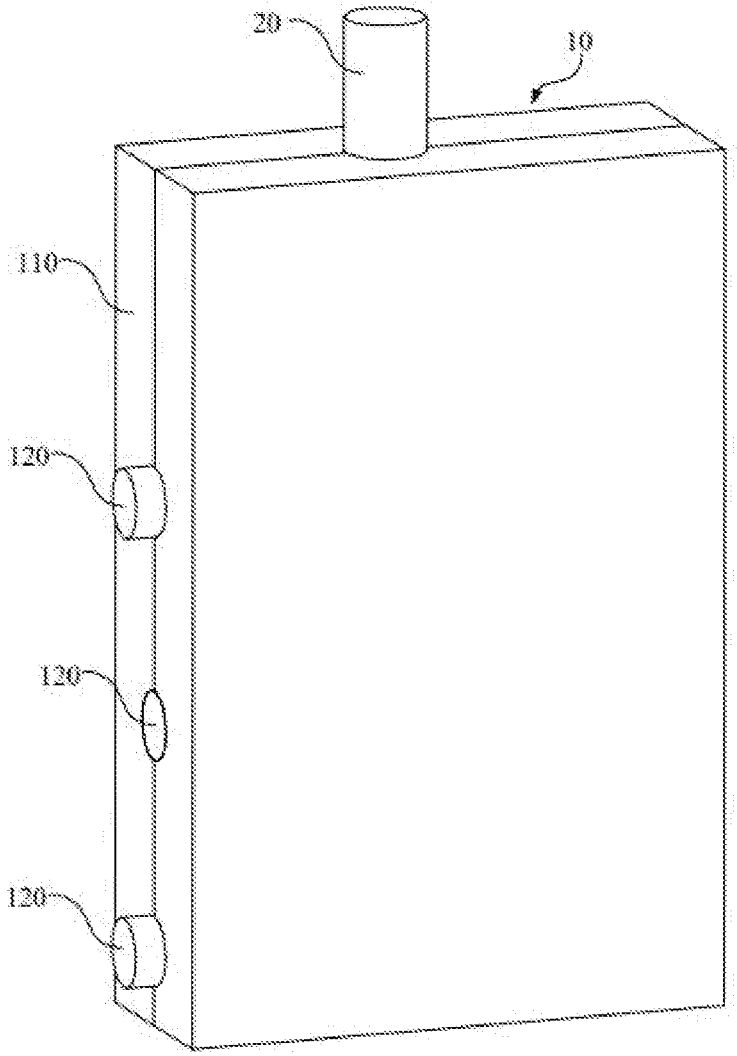
FIG. 1 is a simplified isometric view of an electronic cigarette of low-temperature heating according to an embodiment of the present disclosure.
Figure 4:
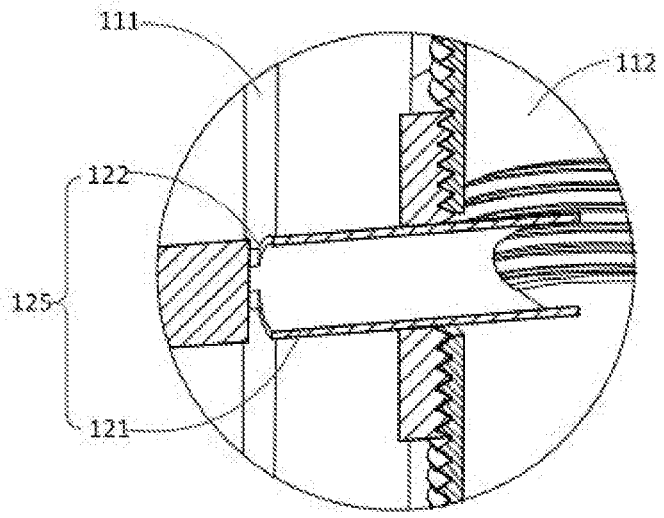
FIG. 4 is a partially enlarged view of part B in FIG. 3.

Referring to FIG. 1 and FIG. 4, the present disclosure generally relates to an electronic cigarette of low-temperature heating 10 equipped with a cigarette 20 for heating the cigarette 20. The electronic cigarette of low-temperature heating 10 includes a housing 10 and a plurality of buttons 120.

In which, the housing 110 has an air inlet passage 111 and an accommodation chamber 112 formed therein. In some embodiments, the housing 110 is made of two semi-housing clamped with each other. The housing 110 are any one of plastic, glass, ceramic or metallic etc. materials.

Each button 120 has an air conductive passage 125; when any one of buttons 120 is pressed down, the air conductive passage 125 communicates the air inlet passage 111 and the accommodation chamber 112 to allow exterior air to flow from the air inlet passage 111 and the air conductive passage 120 that is corresponding to the pressed button 120, consecutively to the accommodation chamber 112. The air conductive passage 125 may be made of any one of plastic, glass, ceramic or metallic etc.

In some embodiments, the air inlet passage 111 and the accommodation chamber 112 are parallel with each other, the buttons 120 are perpendicular with the air inlet passage 111 and the accommodation chamber 112.

In which, the air conductive passage 125 includes an axial conductive pipe 121 and a radial conductive pipe 122 disposed on a pipe wall of the axial conductive pipe 121, when the button 120 is pressed down, the radial conductive pipe 122 and the air inlet passage 111 are aligned with each other to allow exterior air to flow from the air inlet passage 111, the radial conductive pipe 122 and the axial conductive pipe 121 consecutively to the accommodation chamber 112.

Figure 2:
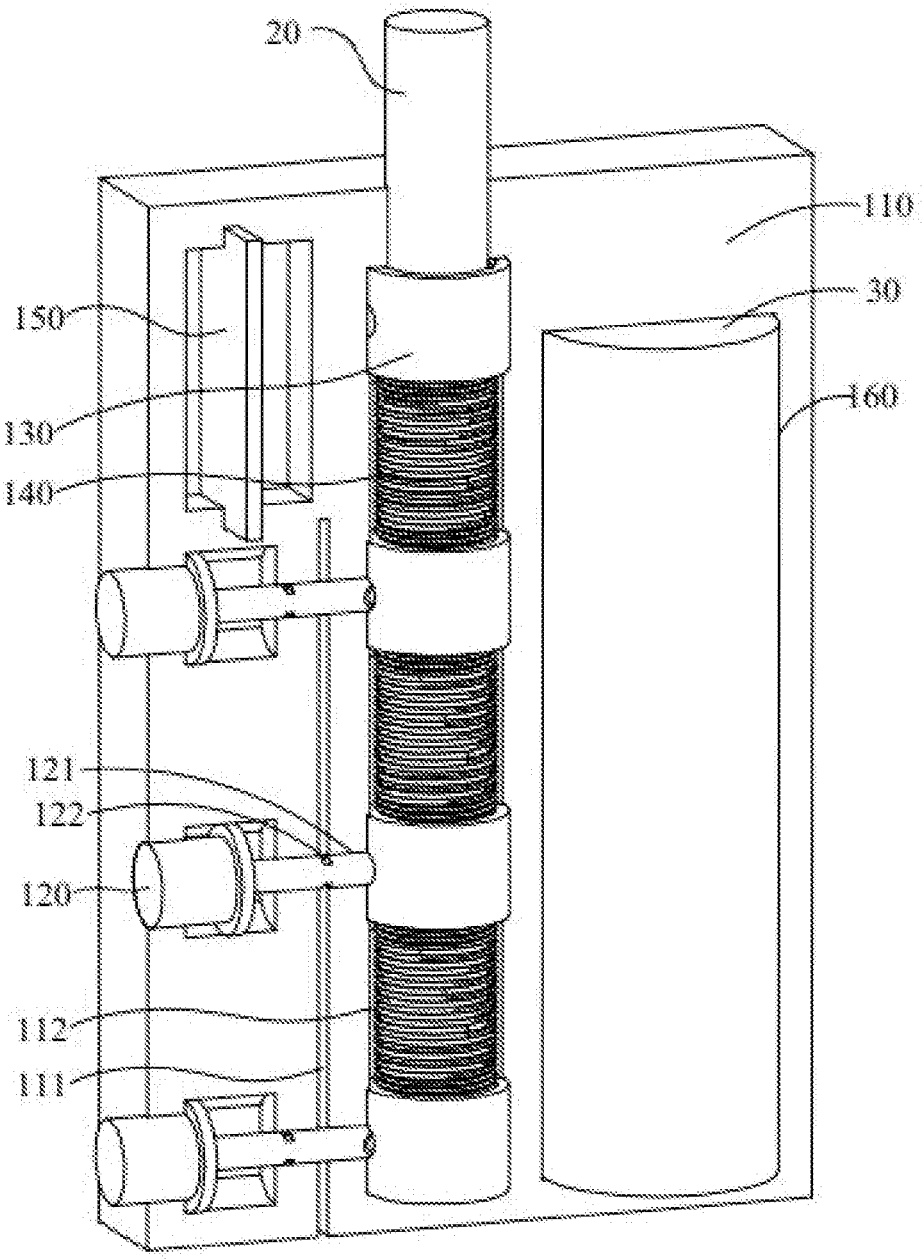
FIG. 2 is a simplified sectional view of an electronic cigarette of an electronic cigarette of low-temperature heating in FIG. 1.
Figure 3:
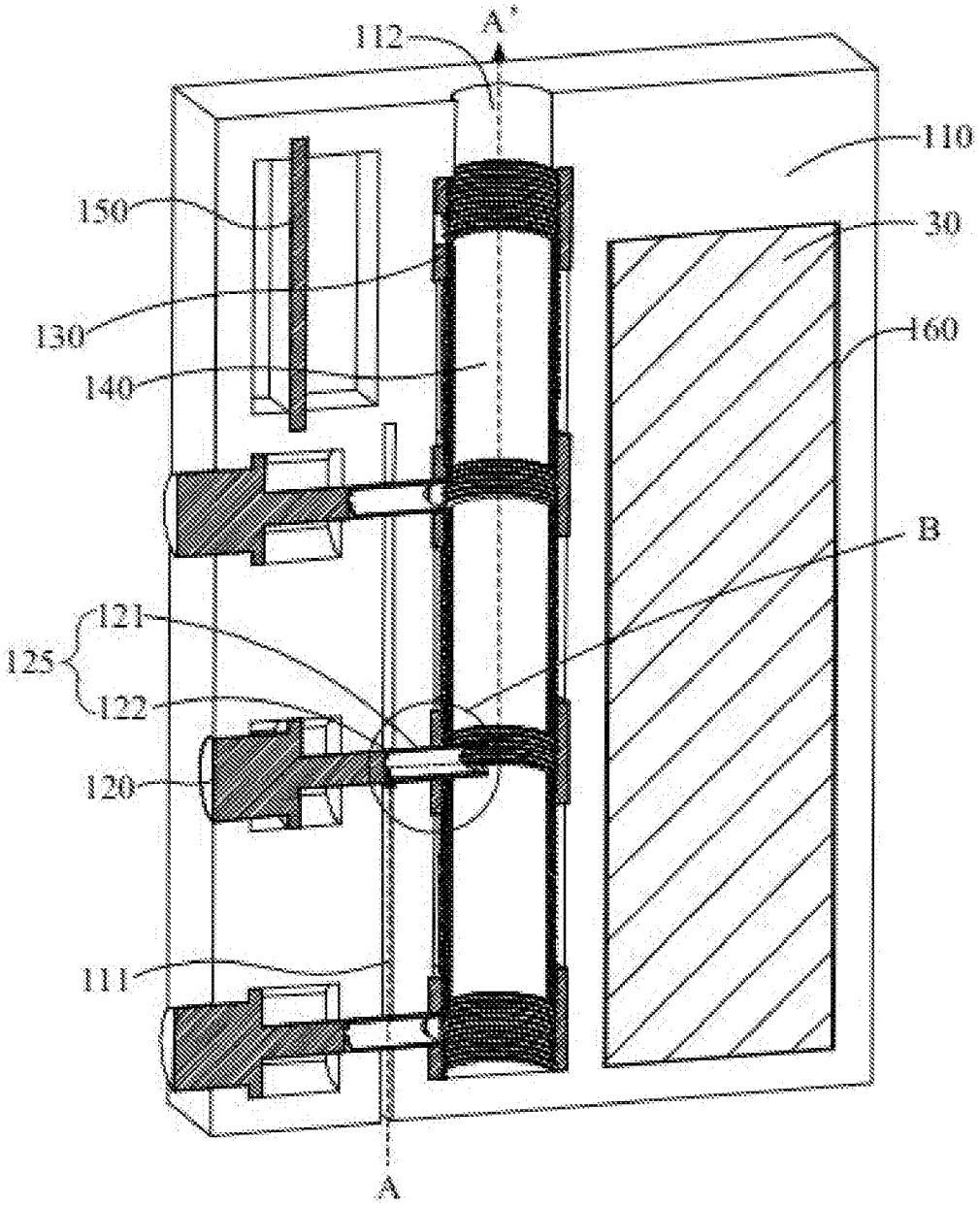
FIG. 3 is a cross-sectional view of the electronic cigarette of low-temperature heating exclusive of vaporizable material (e.g. cigarette) in FIG. 1.

In some embodiments, a diameter of the axial conductive pipe 121 is less than a width of the air inlet passage 111. As shown in FIG. 2 to FIG. 4, when the button 120 at the middle is pressed down and the buttons 120 at the upper and lower ends is not pressed down, the exterior air may flow from the air inlet passage 111, the air conductive passage 125 that is corresponding to the middle button 120, to the accommodation chamber 112. Since the diameter of the axial conductive pipe 121 is less than a width of the air inlet passage 111, the incoming air would not be blocked by the axial conductive passage 121 that is corresponding to the button 120 at the lower end.

In some embodiments, the electronic cigarette of low-temperature heating 10 further includes a heating component and a holder 130. The heating component is disposed inside the accommodation chamber 112. In which, the heating component is fixed inside the accommodation chamber 112 via a plurality of the holders 130, for example, in FIG. 4 there are four holders 130, to be easily understood for the inventors, the number of holders 130 doesn't limit the protective scope of the present disclosure.

In which, the heating component includes a plurality of heating tubes 140, spaced to be disposed among a plurality of holders 130. Each heating tube 140 is further surrounded by a heating wire (not shown).

In some embodiments, the electronic cigarette of low-temperature heating 10 further includes a circuit board 150; the circuit board 150 is respectively connected with multiple heating wires in parallel, when any one of the buttons 120 are pressed down, the corresponding heating wire is conducted by electricity.

In some embodiments, the electronic cigarette of low-temperature heating 10 further includes a power supply chamber 160 for receiving the power supply 30. The power supply 30 is connected with the circuit board 150 and configured for supplying power to the heating wire. The power supply chamber 160 in the electronic cigarette of low-temperature heating 10 may be set to be parallel with the accommodation chamber 112, or be coaxially arranged with the accommodation chamber 112. In other embodiment, the electronic cigarette of low-temperature heating 10 omits the power supply chamber 160, however, with other ways to connect the power supply 30.

In some embodiments, the electronic cigarette of low-temperature heating 10 further includes a controlling circuit for sequence pressing down the buttons 120, corresponding heating wires would be conducted with electricity. The controlling circuit detects whether the buttons 120 are pressed down in line with a preset sequence, if it is in line with the preset sequence, the corresponding heating wires start to work, if not, the heating wires fail to work.

In general, the sequence may be from upper to lower, or firstly pressing down a lowest button 120 so that the cigarette at the bottom starts to be heated. When the cigarette 20 sucked is almost finished, the upper buttons 120 is pressed down sequentially so that the corresponding sections of the cigarette start to be heated. If the upper or middle buttons 120 are pressed down directly at first, though the air inlet passage is opened, the heating wires will not be conducted with electricity to heat the cigarette.

The advantages of the electronic cigarette of low-temperature heating 10 is a novel structure, easy to use and it may avoid the problem that the air passes through heated vaporizable material back and forth, thus delivering burnt flavor or peculiar smell to a user.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An electronic cigarette of low-temperature heating, comprising: a housing, having an air inlet passage and an accommodation chamber formed therein; a plurality of buttons; each button having an air conductive passage; wherein, when one of the buttons is pressed inwards toward the interior of the housing, the air conductive passage corresponding to the button communicates the air inlet passage and the accommodation chamber, to allow exterior air to flow along the air inlet passage and the air conductive passage consecutively to the accommodation chamber, wherein the air conductive passage comprises an axial conductive pipe and a radial conductive pipe disposed on a pipe wall of the axial conductive pipe, when the button is pressed inwards toward the interior of the housing, the radial conductive pipe and the air inlet passage are aligned with each other to allow exterior air to flow from the air inlet passage, the radial conductive pipe and the axial conductive pipe consecutively to the accommodation chamber.

2. The electronic cigarette of low-temperature heating according to claim 1, wherein the air inlet passage and the accommodation chamber are parallel with each other, the buttons are perpendicular with the air inlet passage and the accommodation chamber.

3. The electronic cigarette of low-temperature heating according to claim 1, wherein a diameter of the axial conductive pipe is less than a width of the air inlet passage.

4. The electronic cigarette of low-temperature heating according to claim 1, wherein the electronic cigarette of low-temperature heating further comprises a heating component disposed inside the accommodation chamber.

5. The electronic cigarette of low-temperature heating according to claim 4, wherein the electronic cigarette of low-temperature heating further comprises a plurality of holders configured for fixing the heating component in the accommodation chamber.

6. The electronic cigarette of low-temperature heating according to claim 5, wherein the heating component comprises a plurality of heating tubes, spaced to be disposed among the plurality of holders.

7. The electronic cigarette of low-temperature heating according to claim 6, wherein each heating tube is surrounded by a heating wire.

8. The electronic cigarette of low-temperature heating according to claim 7, wherein the electronic cigarette of low-temperature heating further comprises a circuit board; the circuit board is respectively connected with a plurality of heating wires in parallel.

9. The electronic cigarette of low-temperature heating according to claim 8, wherein the electronic cigarette of low-temperature heating further comprises a power supply chamber for receiving a power supply.

* * * * *